United States Patent [19]

Shlichta et al.

[11] Patent Number: 4,459,470

[45] Date of Patent: Jul. 10, 1984

[54] GLASS HEATING PANELS AND METHOD FOR PREPARING THE SAME FROM ARCHITECTURAL REFLECTIVE GLASS

[75] Inventors: Paul J. Shlichta, San Pedro; Bruce A. Nerad, Burbank, both of Calif.

[73] Assignee: The United States of America as represented by the Administrator of the National Aeronautics and Space Administration, Washington, D.C.

[21] Appl. No.: 342,871

[22] Filed: Jan. 26, 1982

[51] Int. Cl.[3] ..... H05B 3/06

[52] U.S. Cl. ..... 219/522; 219/203; 219/543; 219/541; 219/219; 338/309; 428/432

[58] Field of Search ..... 29/619, 620; 219/203, 219/218, 219, 522, 541, 543, 547; 156/634; 350/1.4, 1.6, 1.7, 164, 166; 428/214, 408, 432; 427/122, 165; 338/308, 309

[56] References Cited

U.S. PATENT DOCUMENTS

| | | | |
|---|---|---|---|
| 3,686,473 | 8/1972 | Shirn et al. | 219/219 |
| 3,790,748 | 2/1974 | Lacthem et al. | 219/219 |
| 4,017,661 | 4/1977 | Gillery | 428/412 |
| 4,251,316 | 2/1981 | Smallbone | 156/634 |
| 4,352,006 | 9/1982 | Zega | 219/219 |
| 4,367,398 | 1/1983 | Strube et al. | 219/541 |
| 4,382,177 | 5/1983 | Heaney | 219/522 |

FOREIGN PATENT DOCUMENTS

| | | | |
|---|---|---|---|
| 1178317 | 1/1970 | United Kingdom | 219/219 |

*Primary Examiner*—Volodymyr Y. Mayewsky
*Attorney, Agent, or Firm*—Paul F. McCaul; Thomas H. Jones; John R. Manning

[57] ABSTRACT

Electrodes (18) are positioned in intimate contact with an outer surface of a thin electrically-insulating protecting layer (16) of architectural reflective glass (20). Application of a voltage of sufficient magnitude substantially destroys the insulating layer (16) located beneath the electrodes (18). A subsequent application of voltage results in a passage of current through the underlying thin, light-reflective metal or metal oxide layer (14) and in concomitant output of heat.

12 Claims, 9 Drawing Figures

FIG. 4
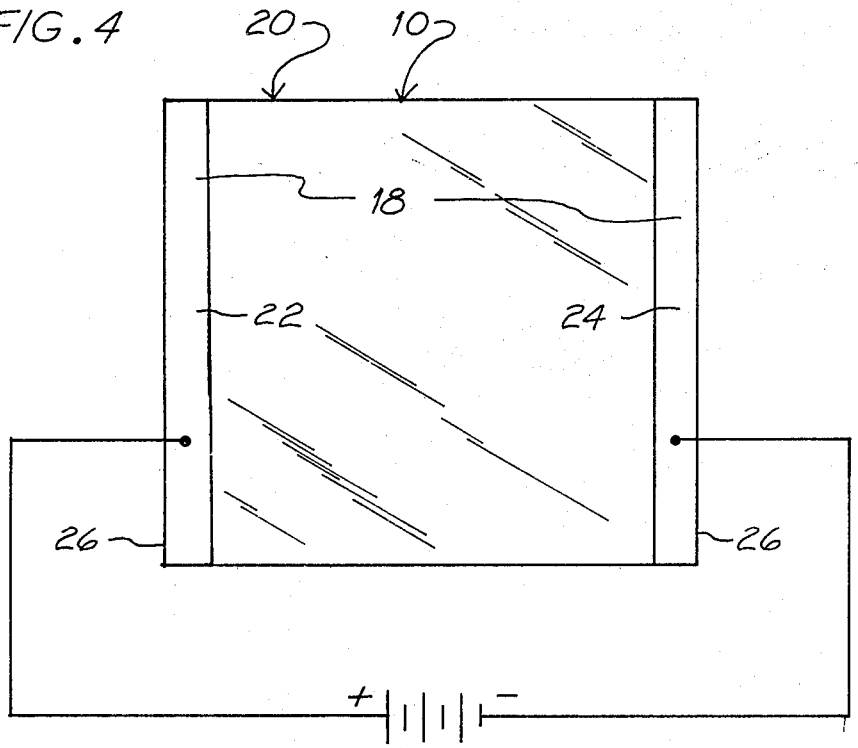
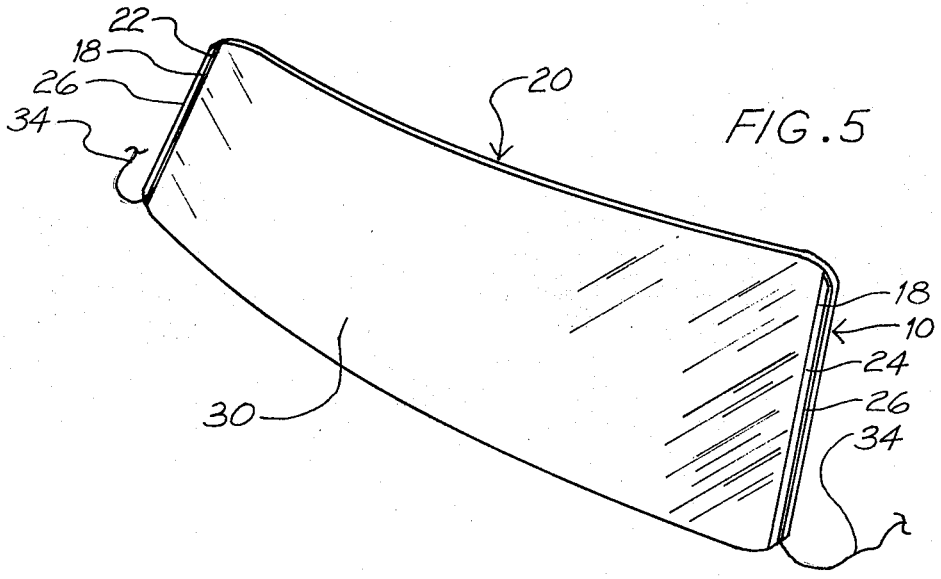
FIG. 5

GLASS HEATING PANELS AND METHOD FOR PREPARING THE SAME FROM ARCHITECTURAL REFLECTIVE GLASS

BACKGROUND OF THE INVENTION

1. Origin of the Invention

The invention described herein was made in the performance of work under a NASA Contract and is subject to the provisions of Section 305 of the National Aeronautics and Space Act of 1958, Public Law 85-568 (72 STAT 435; 43 USC 2457).

2. Field of the Invention

The present invention relates to glass-supported resistive heating elements. More particularly, the present invention relates to glass-supported resistive heating elements which are prepared from commercially available relatively inexpensive architectural reflective glass.

3. Brief Description of the Prior Art

Glass-supported heating elements are known in the prior art. Perhaps the best known examples of the glass-supported heating elements of the prior art are "anti-fog" automobile rear windows and the like.

Typically, the glass-supported heating elements of the prior art such as the "anti-fog" automobile windows comprise a plate or panel of glass which bears on one major surface thereof a plurality of substantially parallel disposed conductive metal wires or deposited metal strips. Application of current to the wires or strips results, in accordance with well-understood laws of physics, in an output of heat which warms the glass plate, panel or window. In some glass-supported heating panels of the prior art, the conductive wires or strips are sandwiched between two plates of glass, rather than being merely mounted to one surface of the glass plate.

A principal disadvantage of the prior art glass-supported heating panels is their relatively high cost. In addition, the common prior art glass-supported heating panels having exposed conductive wires or metal strips on their outer surface are necessarily limited to applications where the exposed wires do not create an undue electrical shock or fire hazard. Due to the above-noted and other disadvantages, the use of electrically-heatable windows in buildings and vehicles, at least up to the present, has not gained wide acceptance. Similarly, the relatively high cost and other disadvantages of transparent, glass-supported heating panels have, up to the present, prevented their widespread use even in specialized applications such as in laboratory instruments and devices, food heating trays, aquariums, and the like.

On the other hand, architectural reflective glass having a thin light-reflective layer on one side thereof, has gained increasing commercial use and acceptance during the last few years. The principal, hitherto, utilized advantage of architectural reflective glass is its ability to enclose working or living space in an aesthetically pleasing and relatively energy-efficient manner. The cost of architectural reflective glass is, on a square foot by square foot basis, only a fraction of the cost of prior art glass-supported heating panels.

Typically, the light-reflective layer of architectural reflective glass comprises a thin coating of metal or metal oxide which is deposited on one side of a glass panel. The metal, or metal oxide layer is covered by another thin, substantially-transparent layer which protects the light reflective metal or metal oxide layer. Many metals and metal oxides such as tin, nickel and lithium oxides are used as the light-reflective layer. The outer, transparent protective layer of architectural reflective glass is usually silica or other transparent insulating material.

The light reflective metal or metal oxide layer of architectural reflective glass usually has low electrical resistance, and the outer protective layer usually has good electrically-insulating characteristics. Nevertheless, the prior art has not, up to the present, adapted or modified architectural reflective glass for applications as heating panels, electrically heatable windows or the like. A reason for this may lie in the fact that, in order to utilize architectural reflective glass as a heating panel, it is necessary to expose a portion of the conductive metal or metal oxide layer to electrodes wherethrough voltage may be applied. However, in accordance with prior art methods, it is exceedingly difficult to selectively remove the insulating silica or like layer from architectural reflective glass, without also adversely affecting the underlying metal or metal oxide layer. For example, it is practically impossible to chemically etch-off selected areas of the outer protective layer of architectural reflective glass without simultaneously also etching off the underlying metal or metal oxide layer.

Accordingly, the present invention is directed to transparent heating panels which comprise architectural reflective glass, and a practical method of producing such heating panels from commercially available reflective glass.

SUMMARY OF THE INVENTION

It is an object of the present invention to provide a low cost glass-supported electrical heating panel.

It is another object of the present invention to provide a low cost transparent electrical heating panel wherein the electrically heated area is readily preselected in substantially any desired configuration.

It is still another object of the present invention to provide a process for producing a transparent glass-supported electrical heating panel at a low cost.

These and other objects and advantages are attained by an electrical heating panel having a plate or panel of glass substantially covered at least on one major surface thereof by a thin light-reflective and electrically-conductive metal or metal oxide layer. The metal or metal oxide layer is covered by a thin layer which is electrically insulating except in two distinct areas wherein further electrically-conductive layers are supported by the glass plate and are in electrical contact with the metal or metal oxide layer. The electrically-conductive layers in the two distinct areas comprise electrodes wherethrough a voltage may be applied causing the metal or metal oxide layer to act as a resistive heating element.

The above-noted heating panel is readily produced from relatively inexpensive readily available architectural reflective glass which has a thin light-reflective electrically-conductive metal or metal oxide layer directly in contact with the glass surface and a thin electrically-insulating layer which covers and protects the light-reflective layer. In order to convert a panel of architectural reflective glass into the above-noted heating panel, a first and a second electrode are applied to the glass panel in distinct areas and in intimate contact with the electrically-insulating protective layer. Thereafter, a gradually increasing voltage or a voltage having or exceeding a predetermined threshold value is applied to the electrodes causing the electrically-insulating layer to break down beneath the electrodes and to bring the electrodes into electrical contact with the underlying electrically-conductive layer. Subsequent application of voltage to the electrodes results in passage of current through the electrically-conductive layer and in output of heat.

The features of the present invention can be best understood, together with further objects and advantages, by reference to the following description, taken in connection with the accompanying drawings wherein like numerals indicate like parts.

BRIEF DESCRIPTION OF THE DRAWINGS

FIG. 4 is a schematic top view of a heating panel of the present invention, the view showing a direct current voltage being applied to electrodes disposed on opposite edges of the heating panel, and FIG. 5 is a schematic perspective view showing an automobile rear window which is adapted to function as a heating panel in accordance with the present invention;

DESCRIPTION OF THE PREFERRED EMBODIMENTS

The following specification, taken in conjunction with the drawings, sets forth the preferred embodiments of the present invention in such a manner that any person skilled in the electrical arts and in the arts relating to the manufacture of reflective glass, can use the invention. The embodiments of the invention disclosed herein are the best modes contemplated by the inventors for carrying out their invention in a commercial environment although it should be understood that various modifications can be accomplished within the parameters of the present invention.

Figure 1:
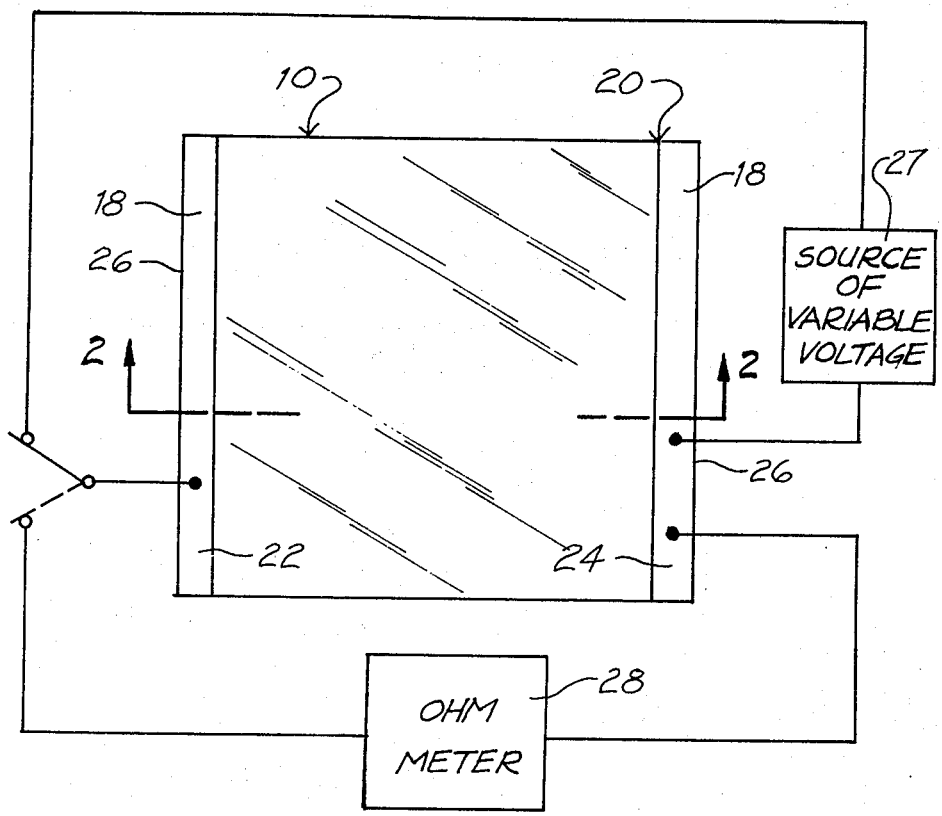
FIG. 1 is a schematic plan view showing a glass panel having a pair of electrodes attached to one major surface of the panel, and a source of gradually increasable voltage connected to the electrodes.
Figure 2:
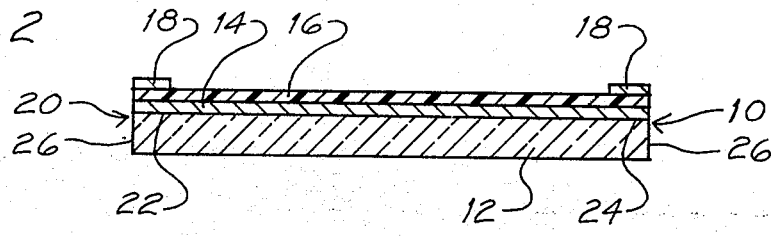
FIG. 2 is a cross-sectional view of the glass panel shown in FIG. 1, the cross section being taken on lines 2,2 of FIG. 1, respective thicknesses of an electrically-conductive layer and an insulating layer on the top surface of the glass panel being exaggerated for illustration.

Referring now to the drawing Figures, and principally to FIGS. 1 and 2, the principles of the novel process of the present invention for producing an electrical resistive heating panel 10 from certain types of commercially-available relatively inexpensive glass panels, are illustrated.

Thus, it has been found in accordance with the present invention that application of a voltage of sufficient magnitude upon a glass panel 12 which has a thin metal or metal oxide coating 14 and a thin insulating coating 16 over the metal or metal oxide coating 14 results in substantial break down of the insulating layer 16 in the areas wherein the voltage is applied. As a consequence, subsequent application of a voltage causes a current to flow through the conductive metal or metal oxide layer 14. The current flowing through the metal or metal oxide layer 14 results in an output of heat, the amount of which is a function of the applied voltage and of the resistance of the conductive layer 14.

More specifically, it has been found in accordance with the present invention, that architectural reflective glass is readily converted into electrical resistive heating panels in accordance with the above-noted principles. As it was noted in the introductory section of the present application for patent, architectural reflective glass is readily available in panels of widely varying sizes. Architectural reflective glass comprises a relatively high quality, smooth surface glass plate or panel 12 which has a thin metal or metal oxide coating 14 on its one surface. The purpose of the thin metal or metal oxide layer 14 is to render the glass reflective to light to a predetermined extent. Nevertheless, the metal layer 14 of architectural reflective glass is always sufficiently thin so as to allow the glass plate 12 covered by the light-reflective layer 14 to be transparent. Manufacturers usually adjust the thickness of the metal or metal oxide layer 14 so that the resulting panel has a 10 to 40 percent transparency to visible light. Accordingly, the thickness of the metal or metal oxide layer in architectural reflective glass is approximately of the $10^{-4}$ to $10^{-6}$ inch magnitude. In accordance with standard practice in the reflective glass manufacturing arts, many metals and metal oxides such as tin oxide, nickel oxide and lithium oxide may be employed as the thin light-reflective layer.

In order to protect the light-reflective metal or metal oxide layer 14 from exposure to the atmosphere and to protect it from mechanical stresses such as abrasion and scratching, the manufacturers of architectural reflective glass deposit a thin relatively hard insulating layer 16 on top of the light-reflective layer 14. The protective layer 16 usually comprises silicates or like material and usually has a thickness comparable to that of the metal or metal oxide layer 14.

The light-reflective layer 14, being of a metal or certain metal oxides composition, is a good conductor of electricity, and the protective layer 16 is a good electrical insulator. Because the above-noted characteristics of the layers 14 and 16 are of great importance for the purpose of the present invention, the light-reflective layer is hereinafter referred to as the conductive layer 14, and the protective layer is hereinafter referred to as the insulating layer 16.

Several manufacturers of glass, manufacture architectural reflective glass having the above-noted characteristics. The present invention may be practiced with such glass. Architectural reflective glass plates marketed as VARI-TRAN glass by the Libbey-Owens-Ford Company are particularly suitable for use in the present invention.

In order to convert architectural reflective glass into the novel heating panels 10 in accordance with the present invention, electrodes 18 are attached to an architectural reflective glass plate 20 in two distinct areas 22 and 24 of the plate 20. In the ensuing description the term architectural glass plate 20 denotes a glass plate together with the above-described conductive layer 14 and insulating layer 16. The term architectural glass plate 20 used in the above-noted sense, is to be distinguished from the term glass plate or panel 12. The latter term denotes only the glass which lies under and physically supports the conductive and insulating layers 14 and 16.

The electrodes 18 which are applied to the architectural reflective glass plates 20 must be in intimate contact with the top surface of the insulating layer 16. The electrodes 18 may be brought into intimate contact with the insulating layer 16 in several ways. A typical method of accomplishing this result in accordance with the present invention is to spread an uncured or semi-cured electrically-conductive resin in the distinct areas 22 and 24 on the top surface of the insulating layer 16 of an architectural reflective glass panel 20, and to allow the resin to cure into a hard layer. Alternative methods for affixing the electrodes 18 to the architectural reflective glass plate 20 include evaporation, sputtering, or chemical deposition of metal layers in the distinct areas 22 and 24.

Resins suitable for the purpose of deposition as electrodes 18 are well known in the art, and usually comprise an epoxy resin having thoroughly dispersed small metal particles. The metal particles are usually silver particles, and the conductive uncured or semi-cured resin is commonly known as "silver paint."

After curing, the hardened conducting layers of plastic (silver paint) comprise the electrodes 18 which are shown on FIGS. 1 through 5. These electrodes 18, are, by their very nature, in intimate contact with the insulating layer 16 of the architectural reflective glass plate 20.

Although this is not a necessary requirement of the present invention, the electrodes 18 are usually placed substantially adjacent to opposite edges 26 of the architectural reflective glass plates 20. Furthermore, the electrodes 18 are usually deposited along the entire length of the opposite edges 26 of the architectural reflective glass panels 20, although, again, this is not a necessary requirement of the present invention.

Referring now to FIG. 1 of the appended drawings and Table I, application of a voltage to the electrodes 18 for the purpose of substantially destroying or "shorting out" the insulating layer 16 disposed in the distinct areas 22 and 24 below the electrodes 18, is described in detail. FIG. 1 schematically shows a source 27 of variable alternating current (AC) or direct current (DC) voltage which may be applied to the electrodes 18, and an ohmmeter 28 which may be used to measure the electrical resistance between the electrodes 18. In this regard it is noted that the voltage applied in the herein described step of the novel process of the present invention is preferably an AC voltage, simply because AC voltage may be readily varied by utilizing a variable transformer (not specifically shown). Therefore, in the ensuing description of the actual embodiments of the present invention, the specifically noted voltage values refer to AC voltages, although, it should be kept in mind that the present invention may also be practiced with a DC voltage source.

Thus, it was found in accordance with the present invention, that the initially measured resistance between the electrodes 18 is very large. For example, when a 4×4 inch square of Libbey-Owens-Ford SILVER VARI-TRAN (1-10B) architectural glass plate having thin silver paint electrodes placed on two of its opposite edges, substantially as shown in FIG. 1, was used, the initial resistance measured by an AC resistance meter was approximately 12,000 ohms. This result, of course, is not surprising in view of the fact that the electrodes 18 are initially separated from the underlying conductive layer 14 by the insulating layer 16. However, when a gradually increasing voltage is applied to the electrodes 18 and the resistance between the electrodes 18 is intermittently measured, the resistance is found to be decreasing until a threshold voltage is reached where slight sparking is observed between the electrodes 18 and the underlying conductive layer 14. At this stage of the process, further gradual increase of the applied voltage, at least up to a certain limit, does not affect the measured resistance between the electrodes 18. Table I indicates the results of an actual experiment wherein the above-noted 4×4 inch square of Libbey-Owens-Ford VARI-TRAN architectural reflective glass plate 20 was used, and wherein the incrementally increased voltage was each time applied for one (1) minute before the resistance was measured.

It is seen in Table I, that in the above-noted example, the threshold voltage is between 40 and 50 volts; more particularly, sparking was first observed when the applied voltage was approximately 40 volts. After the minimum resistance of 100 ohms was reached, further increase of the voltage to 50 volts did not affect the resistance between the electrodes 18. T,0130

The above experiment, and other experiments show that application of a sufficiently high voltage to the electrodes 18 substantially destroys or shorts out the insulating layer 16 which is disposed in the distinct areas 22 and 24 immediately below the electrode strips 18. In fact, it was found in accordance with the present invention that destruction or shorting out of the insulating layer 16 below the electrodes 18 is substantially instantaneous once the threshold voltage is reached.

The actual value of the threshold voltage which is necessary for the "shorting out" to occur, depends on several factors such as the precise nature of the architectural reflective glass panel 20 used, and, more particularly, the thickness of the insulating layer 16. The value of the resistance obtained after the insulating layer 16 is destroyed below the electrodes 18 depends on the nature and thickness of the conductive layer 14, and on the size of the panel 12. However, this resistance, hereinafter referred to as the residual resistance, was found in accordance with the present invention to be very well suited for utilizing the resulting panels as heating panels 10.

Experiments also showed that the shorted-out insulating layer 10 has virtually no resistance or at least much less than the resistance of the conductive layer 14.

It should be understood, that in order to prepare heating panels 10 in accordance with the present invention, it is not necessary to gradually increase the voltage as described in the above-noted specific example. Once the threshold voltage for any particular make and size of architectural reflective glass plate is established, it is possible to merely apply the threshold or a slightly higher voltage to the electrodes 18 for a few seconds thereby converting the architectural reflective glass panel 20 into the heating panel 10 of the present invention.

It is further noted that a wide variety of shapes of the heating panels 10 may be prepared in accordance with the present invention. It is possible, for example, to deposit electrode strips 18 at two remote positions of an architecturally reflective glass panel 20 without depositing the electrode strips on the edges 26 of the panel 20. In such a case substantially only that portion of the architectural reflective glass panel 20 is heated by subsequent application of electrical power, which is disposed between the electrode strips 18. The ease of applying the electrodes 18 by deposition of a conductive polymer, metal evaporation, sputtering, or chemical deposition in substantially any desired configuration to a panel of architectural reflective glass of substantially any desired shape, renders possible the manufacture of heating panels 10 of a great variety of shapes or configuration. For example, substantially only an elongated narrow strip portion of a relatively large window (not shown) may be heated in accordance with the present invention.

The perspective view of FIG. 5 schematically illustrates a somewhat curved heating panel 10, in the configuration of a rear window 30 of an automobile (not shown). The electrically heatable window 30 can be prepared in accordance with the present invention from an architectural reflective glass panel of identical shape at a significantly lesser cost than the prior art electrically heatable rear windows of automobiles.

Figure 3:
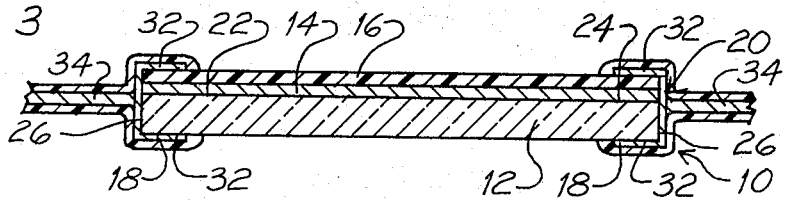
FIG. 3 is a cross-sectional view of another embodiment of a glass heating panel of the present invention, the view showing electrode structures wrapped around opposite edges of the panel, respective thicknesses of an electrically conductive layer and an insulating layer on the top surface of a glass panel being exaggerated for illustration.

Referring now to the cross-sectional view of FIG. 3, another preferred embodiment of the heating panel 10 of the present invention is disclosed. This preferred embodiment differs from the hereinbefore disclosed embodiments only in the manner in which the electrode strips 18 are attached to the architectural reflective glass panel 20. Thus, the uncured or semi-cured conductive epoxy resin is deposited in strips 32 adjacent to opposite edges 26 of the panel 20, on the surface of the panel 20 wherein the insulating layer 16 is on the opposite edges 26, and in strips 32 on the second major surface 33 of the panel 20, as is shown on FIG. 3. After the conductive epoxy resin has cured, suitable wires 34 are positioned to be in contact with the cured conductive resin electrodes 18, and an uncured or semi-cured resin is deposited to cover the electrodes 18 and to eventually form an insulating cover 36 for the electrodes 18.

The novel heating panels 10 of the present invention are stable and operational for prolonged periods of time at applied voltages sufficient to achieve heating of the panels 10 up to temperatures reaching or exceeding 100° C. The panels 10 provide rapid heating and do not undergo significant degradation unless excessively high voltages are applied for heating. Approximately 100 volts AC appear to be the upper experimentally determined limit of voltage which may be maintained for heat production on the heating panels comprising the above-noted Libbey-Owens-Ford VARI-TRAN glass (4×4 inch squares). A sustained application of voltage above 100 volts AC to the above-specified heating panels appears to cause gradual degradation of the conductive layer 14 immediately adjacent to the electrode strips 18. Because the conductive layer 14 is also the light reflecting layer of the architectural reflective glass panel 20, and because the conductive layer 14 also decreases the overall transparency of the glass panel 20, increased transparency observed adjacent to the electrodes 18 indicates degradation of the conductive layer 14.

The heating panels 10 of the present invention can be powered by direct current also, as is schematically illustrated on FIG. 4.

Various utilitarian applications of the hereinabove described heating panels 10 are possible. For example, the relatively inexpensive heating panels 10 of the present invention may be used as electrically-heatable and light-reflecting windows of vehicles (not shown) and buildings (not shown), may serve as food warming trays (not shown), or containers (not shown), or in aquariums (not shown). The transparent glass heating panels 10 of the present invention may also find use in specialized laboratory equipment, for example in containers (not shown) used for studying crystallization processes wherein heatable and transparent glass would permit ready observation of salt systems undergoing controlled temperature changes. The heating panels 10 of the present invention advantageously have a totally electrically-insulated surface. Nevertheless, where prolonged operation submerged in water or electrolytes is desired, the heating panels 10 of the present invention should be protected by additional insulation such as a thick protective outer layer (not shown) or another panel of glass (not shown). Experience indicates that after prolonged operation of the heating panel 10 of the present invention with the conductive side submerged in water, the resistance of the panel 10 gradually increases and eventually the heating panel 10 becomes nonoperational.

Figure 9:
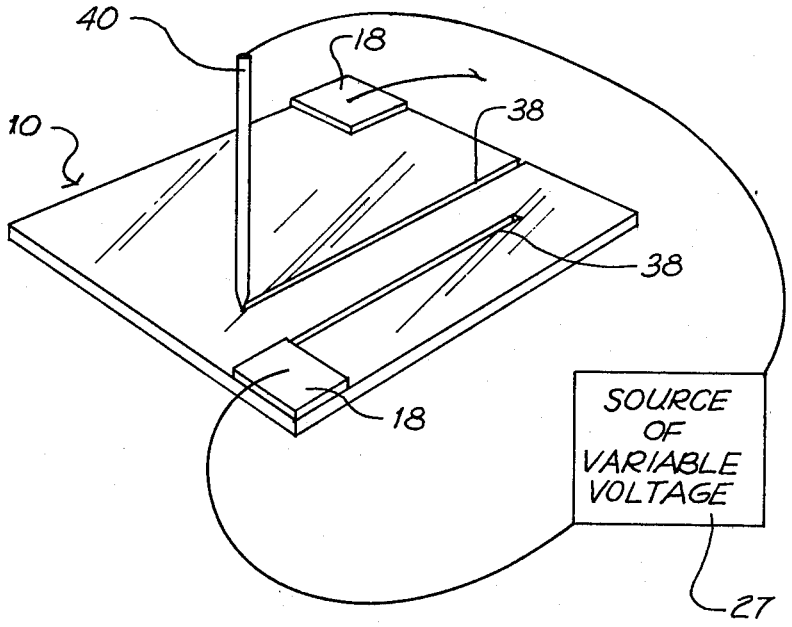
FIG. 9 is a schematic perspective view showing a process of the present invention whereby a non-electrically conductive strip is formed in a desired configuration in the heating panel of the present invention.

Referring now to FIG. 9, a process is disclosed whereby non-electrically conductive strips or areas 38 may be formed on the heating panels 10 of the present invention. More specifically, it was found in accordance with the present invention that if a movable pointed grounded electrode 40 is brought into contact with the insulating layer 16 of the heating panel 10 and simultaneously a sufficiently high voltage is applied, the insulating layer 16 and the electrically conductive and light reflective metal or metal oxide layer 14 are substantially instantaneously destroyed beneath the pointed electrode 40. The voltage sufficient to destroy the electrically conductive layer 14 is nevertheless substantially less than the excessive voltage which during prolonged application destroys the conductive layer 14 beneath and adjacent to the electrodes 18. For example, with reference to the specific architectural reflective glass panel 20 disclosed in connection with Table I, 80 volts AC is sufficient to cause substantially instantaneous destruction or burning-out of the conductive layer 14 beneath the pointed electrode 40.

Figure 6:
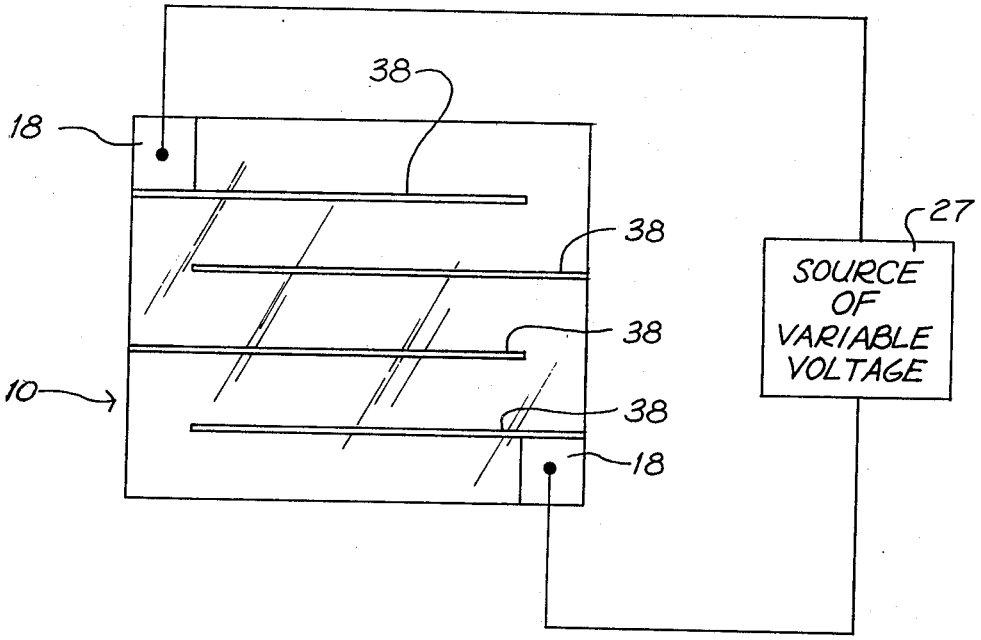
FIG. 6 is a schematic top view of a third preferred embodiment of the heating panel of the present invention.
Figure 7:
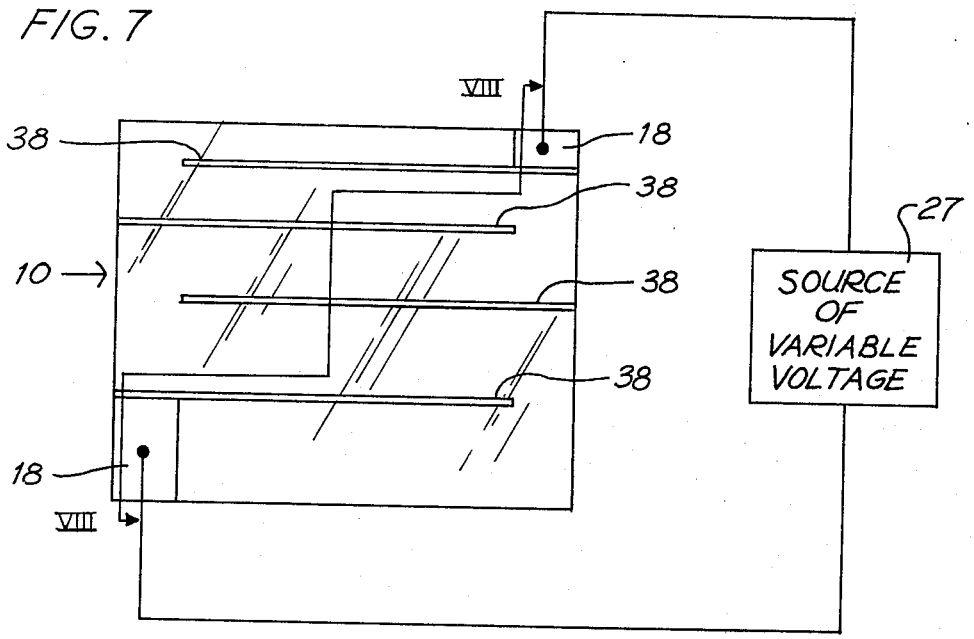
FIG. 7 is a schematic top view of an alternate embodiment where non-uniform heating is provided by non-uniform spacing of the non-conducting areas of the heating panel of the present invention.
Figure 8:
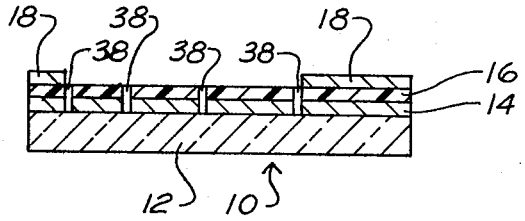
FIG. 8 is a cross-sectional view of the heating panel shown on FIG. 7.

It should already be apparent from the above description and from an inspection of FIG. 9, that the non-conductive strip 38 may be formed or "scribed" on the heating panels 10 in any desired configuration. After removal of the pointed electrode 40, application of voltage causes a flow of current in the heating panels 10 wherein the non-conductive strips 38 act as insulation or barriers to the flow of current. Thus, in net effect, various heating patterns may be created on the surface of architectural reflective glass in accordance with the just-described aspect of the present invention. FIGS. 6, 7 and 8 show such heating panels 10 having non-conductive areas or strips 38.

Since destruction of the conductive layer 14 also increases the transparency of the architectural reflective glass plate 20, the heating panels 10 shown in FIGS. 6–9 also have interesting visual decorative effects. The formation of these non-conductive strips or areas 38 has several advantages. The configurations, such as shown in FIG. 6, permit operation at higher voltages than are possible in a panel of the same shape without non-conductive strips as shown in FIG. 4. In addition the non-conductive areas or strips 38 can be arranged so that the current density has different values at different locations on the panel, thereby providing non-uniform heating of the panel in any desired configuration, as illustrated in FIG. 7.

The principal advantages of the above described heating panels 10 of the present invention are their low cost, ease of preparation, and versatility regarding shape, configuration and application. Several further modifications of the above-described invention may become readily apparent to those skilled in the art in light of the above disclosure. Therefore, the scope of the present invention should be interpreted solely from the following claims.

What is claimed is:

1. A substantially transparent heating element comprising:

a glass object having a thin light-reflecting electrically-conductive layer disposably affixed to, and substantially covering, one major surface of said glass object;

a thin insulating layer permanently affixed to and disposed over said electrically-conductive light-reflective surface layer and substantially covering all area of said major surface including first and second distinct areas;

a first and a second electrically-conductive layer permanently affixed, and disposed over the light-reflecting layer in said first and a second distinct areas, the first and second electrically-conductive layers comprising electrodes adapted for connection to a power source; and means for applying a voltage of sufficient magnitude for substantially destroying the thin insulating layer in the first and second distinct areas and completing an electrical circuit which includes the electrodes and said electrically-conductive layer.

2. The heating element of claim 1 wherein the first and second electrically-conductive layers, respectively, comprise layers of cured polymer film incorporating metal particles.

3. The heating element of claim 1 wherein the light-reflective layer covering one major surface of the glass object is a metal or metal oxide.

4. The heating element of claim 1 wherein the glass object is a substantially flat glass panel having two major flat surfaces, one of said surfaces having the light-reflective layer.

5. The heating element of claim 4 wherein the glass panel is substantially rectangular and the first and second distinct areas respectively comprise strips located substantially adjacent to opposite edges of the panel.

6. A substantially transparent heating element comprising:

a glass panel which is substantially a commercial grade architectural light-reflective glass panel having a thin light-reflective electrically conductive metal or metal oxide layer disposably affixed on one major surface thereof, said glass panel also having a first and a second distinct area on the major surface, and a thin electrically-insulating layer disposably affixed over the light-reflective layer substantially on the whole major surface except over the first and second distinct areas, and a first electrically-conductive layer disposably affixed over the first distinct area, and a second electrically-conductive layer disposed over the second distinct area, the first and second electrically-conductive layers comprising electrodes and being adapted for connection to a power source, the thin electrically-insulating layer having been destroyed in the first and second distinct areas by application of a voltage of sufficient magnitude to the electrodes, whereby the electrodes are in electrical contact with the light-reflective electrically-conductive layer and whereby application of voltage to the electrodes results in passage of current through the light-reflective electrically-conductive layer and in production of heat due to the resistance of the light-reflective electrically-conductive layer.

7. The heating element of claim 6 wherein the first and second electrically-conductive layers comprising the electrodes are strips of electrically-conductive material disposed on the substantially opposite edges of the glass panel.

8. The heating element of claim 6 wherein the resistance of the light-reflective electrically-conductive layer is approximately 100 to 200 Ohms.

9. The heating element of claim 6 wherein the voltage of sufficient magnitude to destroy the thin insulating layer in the first and second distinct areas is approximately 30 to 50 volts.

10. The heating element of claim 6 wherein the first and second electrically-conductive layers disposed, respectively, over the first and second distinct areas comprise electrically-conductive polymeric material which was applied to the respective first and second distinct areas in an at least partially uncured state and was subsequently allowed to cure.

11. The heating element of claim 6 wherein the glass panel is substantially rectangular, and the first and second electrically-conductive layers disposed, respectively, over the first and second distinct areas comprise strips of electrically-conductive material disposed over two opposite edges of the rectangular panel.

12. A heatable pane of reflective transparent glass having a major planar area covered by a transparent light-reflecting layer of material which in turn is covered by a transparent protective coating layer, said heatable glass pane comprising:

electrically-conductive transparent material forming the transparent light-reflecting layer, said material being disposed over and affixed to the major planar area of said transparent glass pane;

electrically-insulating material forming said protective coating layer and being transparently disposed over and affixed to said light-reflecting layer;

a pair of electrically-conductive electrodes affixed in electrical contact with the protective coating layer and positioned at locations which do not block a major transparency area of the glass pane; and means applying to said electrodes a voltage of increasing magnitude sufficient for breaking down the insulative property of said protective coating layer and forming an electrically-conductive heating current path through the electrically conductive layer of the glass pane.

* * * * *